United States Patent [19]

Rohrbach et al.

[11] 4,326,471

[45] Apr. 27, 1982

[54] PROCESS FOR THE CARBONIZATION OF OIL SHALE AND OTHER CARBONIZABLE MATERIALS

[75] Inventors: Gerhard Rohrbach; Bernd Hollman, both of Dotternhausen, Fed. Rep. of Germany

[73] Assignee: Portlandzementwerk Dotternhausen Rudolf Rohrbach Kommanditgellschaft, Dotterhausen, Fed. Rep. of Germany

[21] Appl. No.: 168,058

[22] Filed: Jul. 11, 1980

[30] Foreign Application Priority Data

Jul. 23, 1979 [DE] Fed. Rep. of Germany ..... 2929786

[51] Int. Cl.[3] ..... F22B 7/00

[52] U.S. Cl. ..... 110/341; 44/1 F; 44/10 C; 110/229; 110/230; 110/347

[58] Field of Search ..... 110/229, 230, 341, 347; 44/1 F, 10 C

[56] References Cited

U.S. PATENT DOCUMENTS 4,253,409 3/1981 Wormser ..... 110/347

FOREIGN PATENT DOCUMENTS 1143292 2/1963 Fed. Rep. of Germany ..... 110/230

*Primary Examiner*—Edward G. Favors

*Attorney, Agent, or Firm*—Scully, Scott, Murphy & Presser

[57] ABSTRACT

A process for the carbonization of oil shale and/or other carbonizable materials, including a process line serving for carbonization, with a closed cycle and without condensate recovery, wherein the materials flowing through the process line are heated to the carbonization temperature through heat exchange. Coming into consideration as further carbonizable materials are fuels which are high in inerts such as, for example, bituminous rock, oil-containing fuller's earth, high-ash coal, oil sands, refuse and the like.

7 Claims, 1 Drawing Figure

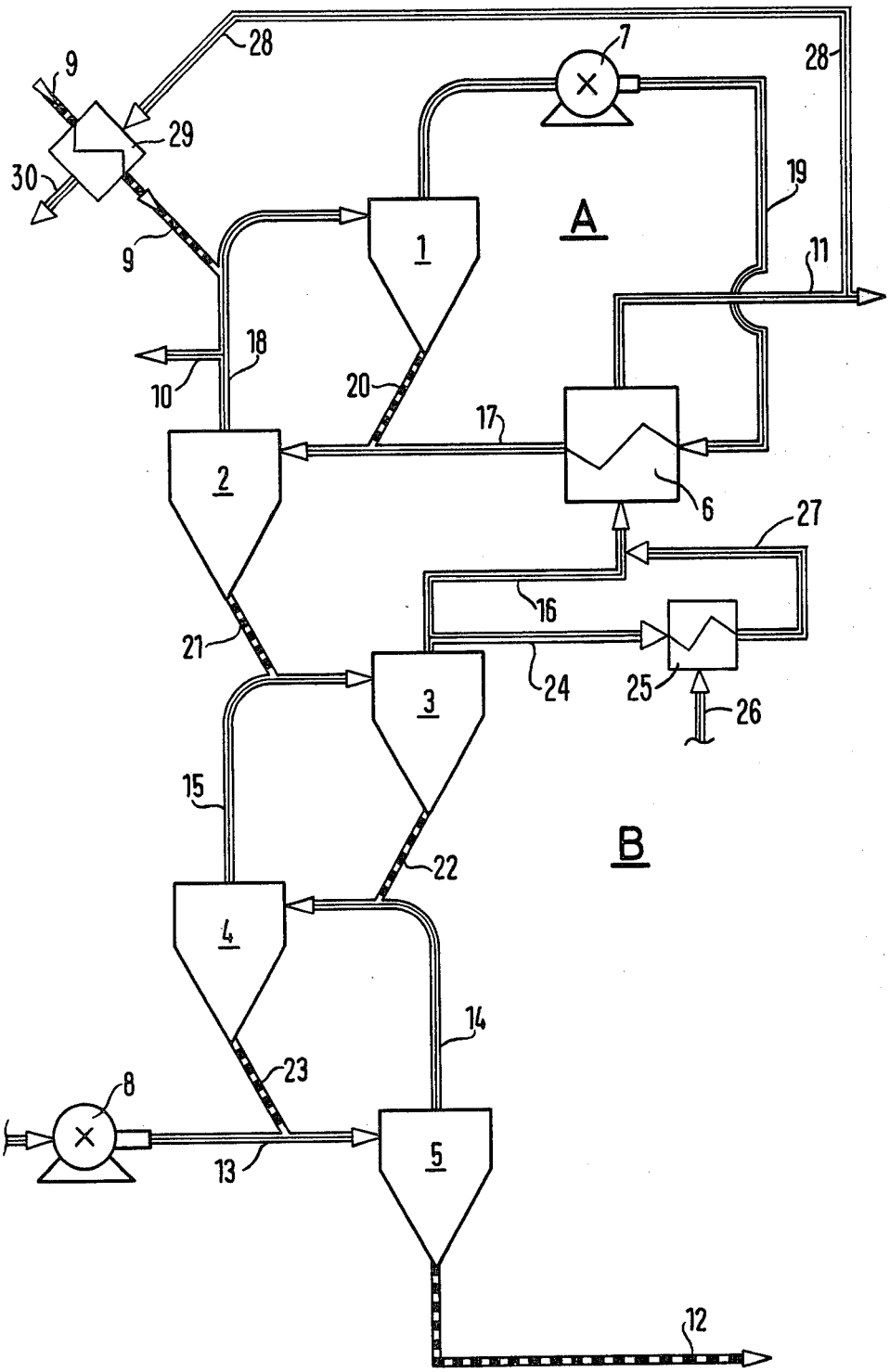
28
9
29
30
9
7
28
19
A
1
11
18
10
20
17
2
6
27
16
21
24
25
26
3
15
B
22
4
14
23
8
13
5
12

PROCESS FOR THE CARBONIZATION OF OIL SHALE AND OTHER CARBONIZABLE MATERIALS

BACKGROUND OF THE INVENTION

1. Field of the Invention

The present invention relates to a process for the carbonization of oil shale and/or other carbonizable materials, including a process line serving for carbonization, with a closed cycle and without condensate recovery, wherein the materials flowing through the process line are heated to the carbonization temperature through heat exchange.

Coming into consideration as further carbonizable materials are fuels which are high in inerts such as, for example, bituminous rock, oil-containing fuller's earth, high-ash coal, oil sands, refuse and the like.

2. Discussion of the Prior Art

Numerous processes have already been proposed for the carbonization of oil shale and similar fuel-containing materials having a high proportion of inert materials, for some of which pilot plants have also been constructed. However, it is difficult to completely utilize the fuel content of the raw material and with a satisfactory degree of efficiency since, in essence, subsequent to the carbonization there remains a predetermined proportion of fuel, particularly carbon, in the carbonized material, whose heat of combustion can frequently not be employed, and if so then only with extensive and complex apparatus.

A survey of such processes is elucidated in E/MJ (September 1977) pages 148 through 154. One of the previously mentioned processes is described therein under the designation "Lurgi L.R." In the known process the decarbonized raw material which is conducted through the cycle is employed as a heat carrier. After the carbonization this raw material is pneumatically conveyed into a storage bin, whereby there is burned the so-called fixed carbon so as to lead to an increase in the sensible heat beyond the carbonization temperature. The conveying air, which is concurrently utilized as combustion air for the combustion of the fixed carbon, leaves this process line into the atmosphere at combustion temperature and is lost. Also the heat which is contained in the ash, in effect, in the fully burned-out raw material, is lost.

In another process which is referred to in that publication, ceramic spheres are heated through the combustion of process gas, and which serve as solid heat carriers for the heat which is required during the carbonization process. For the heating of the ceramic spheres there is utilized a special sphere heater whose exhaust gases serve for the preheating of the raw material which is to be carbonized such as oil shale. In this process, the fixed carbon which still remains in the raw material subsequent to the carbonization is not utilized. The carbonized residue leaves the process at the carbonization temperature (approximately 500° C.) and must be cooled by being sprayed with water since it will otherwise continue to burn and represent a significant burden on the environment (for instance, a stench).

Other processes which are mentioned therein utilize carbonization gas which is conveyed in a closed cycle as a heat carrier. This gas is heated either directly through combustion or through indirect heating. Employed as the cycle gas is the incondensible component of the carbonization gases. Thus, the cycle gases are cooled to condensate precipitation, so as to be thereafter again heated for heat transfer for the carbonization process. This results in a significant heat loss with a correspondingly lowered degree of efficiency. A still satisfactory degree of heat is possessed by a process wherein the heat which is transferred to the cycle gas originates from the combustion of the fixed carbon. Even in this process does the ash leave the process at a combustion temperature of about 800° C.

Moreover, there have also been proposed retort processes with indirect heat transfer from the gas to the solid material, however, these have not been found any applicability since the indirect heat transfer of gas/solids material in the required large operating units, due to the large heat transfer surfaces then required, lead to presently uncontrollable constructions.

Additionally, there have also been previously proposed so-called on-site processes in which the raw material is carbonized in its original deposit whereby the fixed carbon should also presently be burned. These on-site processes have also failed to find application in view of the difficulty soluable problems of a controlled process conductance. For such processes for relatively high-yield oil shale, reports have been made of a yield of merely about 50 to 60%.

In the decarbonization of other raw materials, processes have already been proposed which are not suitable for the carbonization of carbonizable material such as oil shale and similar raw materials.

For example, from German Pat. No. 11 60 823 there has become known a process for continuous degassing, such as the carbonization and/or coking of fine-granular, non-caking water-containing fuels through the intermediary of hot gas streams. This process is particularly suited for the production of coke as the primary product, whereas carbonization gas occurs as a side-product which is thinned-out through the combustion gases of the heat generator. For the carbonization of oil shale and other carbonizable raw materials with high contents of inert materials and with an also necessarily low fuel content; however, this process is not suitable since the process residue still contains the fixed carbon and no combustion is provided. Since the residue exists from the process at carbonization temperature, for a large quantity of residue the heat requirement of the process is extremely high whereby so as to also require extremely large quantities of combustion gas in order to be able to maintain the necessary process temperature. The thereby obtained thinning of the carbonization gases reduces the heat value of the noncondensable gases so extensively for introduced low-grade materials, that it practically precludes any utilization of the gases. For fuel-poor, ash-rich materials, such as oil shale or the like, whose commerical utilization is the object of the invention, this process is also not suitable. The same also pertains to a similar known process as well as an arrangement for the continuous thermal treatment, such as degasification and/or coking, of fine-granular water-containing fuels; having reference to German Laid-Open Patent Application 16 71 320. Also in this instance it is impossible to recover an unthinned high-quality carbonization gas. The carbonization gas extensively contains the exhaust gases of an external heat generator.

In another known process for the degasification of powdered fuels (as in German Pat. No. 977,218) there is employed a distillation chamber in which the material is loosened by means of the introduction of $CO_2$ or steam to a density of 8 to 80 g/l. The introduced gases thin out the product gas. The required heat quantity is conveyed into the distillation chamber through the intermediary of a solid heat carrier from a further similar treatment chamber, and in which there is combusted the remaining carbon and, as occasioned, auxiliary fuel. The excess combustion residue and the exhaust gases from this combustion stage leave the process at the temperature of the combustion stage. The thusly generated high heat losses can only by avoided by extensive additional measures for facilitating utilization of the exhaust gas heat.

Finally, also known is a process and an arrangement for the degasification of fine-granular up to dust-like fuel (refer to German Pat. No. 11 97 432), in which there are employed as essential components at least two air heaters acting as heat exchangers as primarily employed in the foundry industry. This process operates in an alternating manner whereby one of the air heaters is currently heated for the combustion of the incondensible gas and the stored heat of currently the other air heater is transferred to a mixture consisting of carrier gas and the fuel which is to be degasified. This process is also not suited to the carbonization of oil shale and similar carbonizable fuels which are high in inerts, since the fixed carbon material cannot be utilized and, in essence, because the air heaters are heated with incondensible gas. Moreover, the carbonized residue is removed at the carbonization temperature so that the heat losses are also appreciable.

SUMMARY OF THE INVENTION

Accordingly, it is an object of the present invention to so formulate a process of the above-mentioned type whereby, with the simplest possible construction, the residual fuels can be utilized as completely as possible and there can be employed the remaining heat.

The foregoing object of the invention is attained through a process for the carbonization of oil shale and/or other carbonizable materials wherein a known per se closed cycle consists of a gas cycle, that the fuel which remains in the carbonized residue, in particular carbon, is combusted in an open second process cycle, and wherein the thereby recovered heat in the exhaust gas of the combustion is conveyed into a first process cycle through heat exchange, and wherein the combustion air is subjected to a heat exchange with the ash of the combustion stage in the second process cycle.

Thus, the invention extends into two mutually separated two process steps, in effect, on the one hand the carbonization of the carbonizable material, essentially, the material which is to be carbonized, and the combustion of the residual fuel in the already carbonized material, in effect in a carbonized residue. In effect, they are separated from each other on the gas side and merely thermally connected with each other. As a consequence, use can be made of installations which are simply constructed and employed in the chemical processing technology. Thus, for example, it is possible to effectuate the combustion of the fixed carbon in the carbonized residue in a cyclone system which is so constructed that the introduced combustion air assumes the largest part of the heat from the ash through heat exchange. Nevertheless, there can also be used other systems in lieu of the cyclone system which achieve a similar effect, for instance, such as may be employed in the stone work and earth industry, as for example in pit construction, rotating tubes, and so forth. In this manner it is also possible to reach the required combustion temperature with extremely small quantities of the residual fuels which are contained in the carbonized residue whereby, in general, the so-called fixed carbon is adequate. The combustion heat which is almost completely contained in the exhaust gas of the open second process cycle serving for the heat generation is extensively transferred with the aid of an indirect gas/gas heat exchanger to the gas in the carbonization cycle, in effect, into the first process cycle and hereby covers the heat requirement for the remaining heating of the introduced material which is to be carbonized, in essence the employed material, up to the carbonization temperature and for the carbonization process itself.

It is basically possible to equip the closed carbonization cycle with only a single carbonization stage. The cycle gases will then enter into the heat exchanger at the carbonization temperature before they are reheated anew. Also, due to the then increased demand on the conveying component of the carbonization gas it is mostly purposeful to previously cool the cycle gases in that they are admixed with and again separated from the relatively cold employed material, in effect, the raw material which is to be carbonized, so that the employed material is heated through direct heat exchange before it is subjected to the actual carbonization. Resultingly, there can also be reduced the required quantity of cycle gas and/or the necessary temperature thereof prior to the entry into the actual carbonization stage. Dependent upon the heat requirement there can be generally applied to the inventive process, although not necessarily, precedent drying and preheating steps with exhaust gas from the second process cycle whereby, as desired, there can be eliminated one of the preheating steps within the first process line for the carbonizing gas cycle.

Through the invention it is possible to achieve a complete utilization of the residual fuel remaining in the carbonized material after carbonization, in general, about 3%–6% whereby the thereby produced heat quantities are primarily employed for the covering of the heat losses of the process. The employment of auxiliary fuels is purposeful for such employed materials which evidence a too low residual fuel content of, for example, 1.5%. In addition thereto, through the invention it is possible to achieve an extensive utilization of the heat content of the ash, in effect, the carbonized residue freed from the residual fuel, as well as an extensive utilization of the heat content of the exhaust gases from the combustion of the residual fuel whereby, additionally, it is possible to produce unthinned carbonization gases.

BRIEF DESCRIPTION OF THE DRAWING

The invention is now more closely elucidated in connection with the following exemplary embodiment in which the single FIGURE of the drawing illustrates a schematic flow diagram of an arrangement for effectuating the inventive process.

DETAILED DESCRIPTION

Provided in the inventive process is essentially a first process line A with a closed cycle as well as an open cycle second process line B.

A tube conduit 18 located between a separator 2 of the carbonization stage and a separator 1 of the first process line A receives the raw material which is to be carbonized through a conduit 9 whereby this raw material will admix dispersion-like with the gas flow circulating through the process line A. Within the tube conduit 18 there is thus produced a mixing temperature intermediate the gas at the carbonization temperature and the temperature of the colder introduced raw material which is to be carbonized. The working material which has been admixed and preheated by the gas is again separated in separator 1 from the gas in the gas cycle of the first process line A. A blower 7 serves for conveying the gas within the gas cycle and, in essence through a conduit 19 to an indirect heat exchanger 6 and from there again through a conduit 17 to the separator 2 of the carbonization stage. The working material which is separated in the separator 1 is again admixed through a transfer conduit 20 with the gas in the gas cycle and, in essence, in the connecting conduit extending intermediate the heat exchanger 6 and the separator 2. The heat quantity which is introduced to the gas in the gas circuit in the heat exchanger 6 is measured so that in the separator 2 there is reached the desired carbonization temperature which, generally, lies between 400° C. and 700° C. By means of the conduit 18 between the separator 2 and the separator 1 there is closed the gas cycle of the carbonization gas. Through the intermediary of a withdrawal conduit there is withdrawn a quantity of gas from the gas cycle corresponding to the presently generated carbonization quantity. Through a gas withdrawal conduit (not shown) there can be recovered from the conduit 19 a second and therefrom distinguishing gas.

From the separator 2 of the carbonization stage there exits through a transfer conduit 21 at a corresponding heat requirement the at least partially but mostly completely carbonized material to the second process line B operating as a combustion cycle and is hereby introduced into a conduit 15 intermediate separators 4 and 3 within which there flows a gas, as a result of which the solid material which is introduced through the conduit 21 is admixed dispersion-like into the gas flow. Taking place in the conduit 15 and in the separator 3 is the combustion of the fixed carbon since there is now available sufficient oxygen for the combustion. In the event that the heat value of this combustion is still inadequate to cover the heat losses, then a residue of the carbonizable components and/or an additionally introduced support fuel can find utilization. Thus, at least a part of the exhaust gas from separator 3 is conducted through conduit 24 to combustion heater 25, which is supplied with supplemental support fuel through conduit 26. The exhaust gas, now containing additional heat value, is conducted through line 27 to line 16 for transfer of its heat in heat exchanger 6. In the indirect heat exchanger 6, into which there is conducted the exhaust gas from the separator 3 through a conduit 16, a large portion of its heat content is withdrawn from this exhaust gas and transferred to the gas cycle of the first process line A. The residual heat can hereby be so calculated as to be sufficient to cover the heat requirement during a material drying and/or preheating preceding the actual carbonizing process, as a result of which the exhaust gas which is conducted away from the indirect heat exchanger 6 through a conduit 11 can be at least partially conducted to such an installation. In particular for working materials with a high component of fixed carbon can there be generated excess heat which can then be withdrawn through the conduit 11 or even at the conduit 16. Naturally this excess heat can be further employed for other purposes. For example, after the exhaust gas exits from heat exchanger 6, at least a portion of it can be conducted from conduit 11 through conduit 28 to indirect heat exchanger 29 wherein its heat is transferred to dry and preheat the raw material entering the system through line 9. The exhaust gas is conducted from the heat exchanger through line 30 for utilization of any remaining residual heat.

The ash which is removed from the separator 3 through a conduit 22, and which now does not contain any further combustible residues, is subjected to a heat exchange with the combustion air and, in certain instances, with excess air. This can be achieved in the above-mentioned manner through a multiple admixing of the ash with air and the subsequent separation of the solid material by means of separators, as is illustrated in the drawing through a twice effected mixing. The ash is here mixed in through the conduit 22 into a gas conduit 14 and again separated in the separator 4 whereby the ash which is separated from the separator 4 through a conduit 23 is mixed into an airstream aspirated from a blower 8 and introduced into a conduit 13, whereupon the ash is again separated in a separator 5 and conducted through a conduit 12 for further utilization.

Hereby, fresh air at about 20° C. is introduced into the open cycle second process line B by means of the blower 8. At the mentioned carbonization temperature of 500° C., which also is possessed by the material in the conduit 21, for instance, at a residual fuel content of about 3% there can be reached a temperature of about 800° C. for the exhaust gas in the conduit 16. Through a suitable number of separators, which preferably and as schematically illustrated can be constituted of cyclone separators, there can be achieved a desired low outlet temperature for the discharged materials.

What is claimed is:

1. In a process for the carbonization of oil shale or other carbonizable materials including a process line with a closed cycle and without condensate recovery wherein materials flowing through said process line are heated to carbonization temperature through heat exchange, the improvement comprising: said closed cycle being a gas cycle; combusting fuel remaining in the carbonized residue, particularly carbon, in an open-cycle second process line; conveying the heat recovered in the exhaust gas of said combustion through heat exchange to said first process line whereby the combustion air is subjected to a heat exchange with the ash of the combustion step in said second process line.

2. A process as claimed in claim 1, comprising additionally combusting support fuel in said second process line.

3. A process as claimed in claim 1 or 2, comprising conveying the raw material to be carbonized in said first process line at least once into a dispersion-like admixture with the gas in said closed gas cycle; and again separating said material from said gas.

4. A process as claimed in claim 1 or 2, comprising conveying the at least partially decarbonized raw material from said first process line at least once into a dispersion-like admixture with oxygen-containing gas in said second process line; and again separating said material from said gas.

5. A process as claimed in claim 1, comprising at least partially utilizing excess heat after heat exchange in the exhaust gas of said second process line for the drying and preheating of raw material to be carbonized and conducted into said first process line.

6. A process as claimed in claim 1, comprising separating the carbonized residue and the gas in said first process line and the at least once produced dispersion-like admixture in separators into gas and solids.

7. A process as claimed in claim 6, each said separator being a cyclone separator.

* * * * *